US007258529B2

(12) United States Patent
Wagner

(10) Patent No.: US 7,258,529 B2
(45) Date of Patent: Aug. 21, 2007

(54) SECURING ASSEMBLY

(75) Inventor: Stefan Jochen Wagner, Derby (GB)

(73) Assignee: Rolls-Royce plc, London (GB)

( * ) Notice: Subject to any disclaimer, the term of this patent is extended or adjusted under 35 U.S.C. 154(b) by 244 days.

(21) Appl. No.: 11/041,257

(22) Filed: Jan. 25, 2005

(65) Prior Publication Data

US 2005/0232760 A1 Oct. 20, 2005

(30) Foreign Application Priority Data

Feb. 14, 2004 (GB) ..... 0403294.2

(51) Int. Cl.
*F01D 5/30* (2006.01)

(52) U.S. Cl. ..... 416/220 R

(58) Field of Classification Search ..... 416/220 R; 403/316, 318, 319

See application file for complete search history.

(56) References Cited

U.S. PATENT DOCUMENTS 2,224,935 A * 12/1940 Schultz ..... 192/45.1
4,767,276 A 8/1988 Barnes et al.
4,803,893 A * 2/1989 Bachinski ..... 464/180
5,257,909 A 11/1993 Glynn et al.
5,302,086 A * 4/1994 Kulesa et al. ..... 416/221
5,338,154 A * 8/1994 Meade et al. ..... 415/173.7

FOREIGN PATENT DOCUMENTS

EP 0 833 039 A 4/1998
GB 2 270 544 A 3/1994

* cited by examiner

*Primary Examiner*—Ninh H. Nguyen
(74) *Attorney, Agent, or Firm*—Oliff & Berridge, PLC

(57) ABSTRACT

A securing assembly comprises a first rotatable member defining a first recess. The assembly also includes a second rotatable member defining a second recess. The first recess has an engagement formation. Securing means are locatable in the first and second recesses for securing the first and second rotatable members to each other. An urging formation is provided on one or both of the securing means and the second rotatable member for urging the securing means into engagement with the engagement formation when the first and second rotatable members are rotated.

25 Claims, 6 Drawing Sheets

SECURING ASSEMBLY

This invention is used for securing assemblies. More particularly, the invention relates to securing assemblies for securing together two rotatable members, for example in a gas turbine engine.

In a gas turbine engine, the components such as cover plates or seal plates for securing these turbine blades onto the turbine discs use bayonet type fixings. These arrangements tend to produce high windage features leading to the generation of heat.

According to one aspect of this invention, there is provided a securing assembly comprising a first rotatable member defining a first recess, a second rotatable member defining a second recess, the second recess having an engagement formation, securing means rotatable in the first and second recesses for securing the first and second rotatable members to each other, and an urging formation provided on one or both of the securing means and the first rotatable member for urging the securing means into engagement with the engagement formation when the first and second rotatable members are rotated.

The engagement formation may comprise an engagement wall.

The urging formation may comprise an urging wall of the first recess. The urging wall may be angled relative to the axis of rotation of the first and second rotatable members to effect the aforesaid urging of the securing means.

Alternatively, or in addition, an urging formation may be provided on the securing means. The urging formation on the securing means may comprise an urging wall, which may be chamfered. Preferably, the urging wall is chamfered relative to the axis of rotation of the first and second rotatable members. Where the urging formation is also provided on the first rotatable member, in the form of the first mentioned urging wall of the recess, the first mentioned urging wall and the second mentioned urging wall may define the same angle relative to the axis of rotation. The first mentioned urging wall may face inwardly of the recess, and the second mentioned urging wall may face the first mentioned urging wall.

The first and second rotatable members may each comprise a respective first and second recess defining portions to define the first and second recesses. The first and second recess defining portions may extend through at least an arc of a circle. At least one of the first and second recess defining portions may be generally annular. Preferably, both of the first and second recess defining portions are annular.

The first and second recesses may extend through an arc of a circle. At least one of the first and second recesses may be generally annular. Preferably, both of the first and second recess are generally annular.

Preferably, the first and second recesses are aligned with each other to define an internal channel when the securing means is received therein.

The securing means may include at least one, or a plurality of, securing members. The, or each, securing member may be locatable in the first and second recesses. The, or each, securing member may be slidable into the first and second recesses.

A pair of said securing members are preferably locatable in general co-axial alignment with each other in the recesses. Each securing member may comprise a half ring.

In another embodiment, the securing means may comprise two securing members, each of which may be annular in configuration, and each may have a break therein. The break may extend radially across the securing member. In this embodiment, each securing member may comprise a split ring.

In one embodiment, two pairs of securing members arranged opposite to each other around an annulus, wherein the securing members of each pair are arranged co-axially of each other. Preferably, each securing member extends around generally a semi-circle of the annulus.

Alternatively, the securing member may be annular in configuration, and may comprise an annular member wherein a portion of the annular member overlaps another portion of the annular member. Preferably, the securing member is in the form of a spiral member which may have two full turns. Each turn may engage an adjacent turn. Preferably, the securing members are slidable into the recesses.

The first and/or the second recess may define an aperture to enable the, or each, securing member to be located within the recesses.

An embodiment of the invention will now be described by way of example only, with referencing accompanying drawings, in which.

Figure 1:
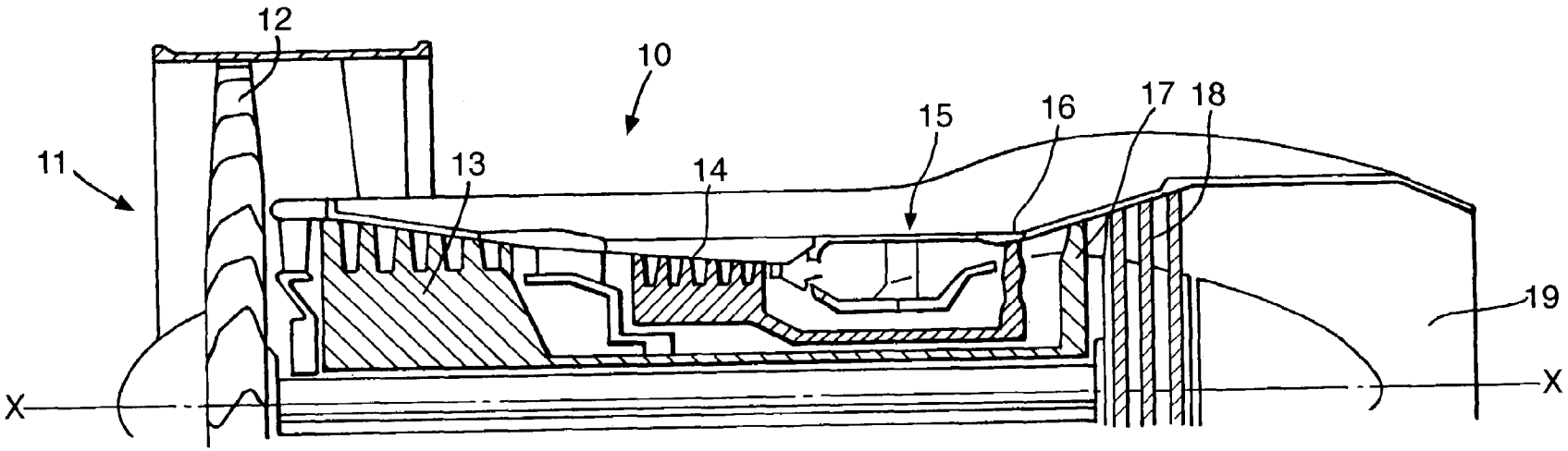
FIG. 1 is a sectional sign field of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
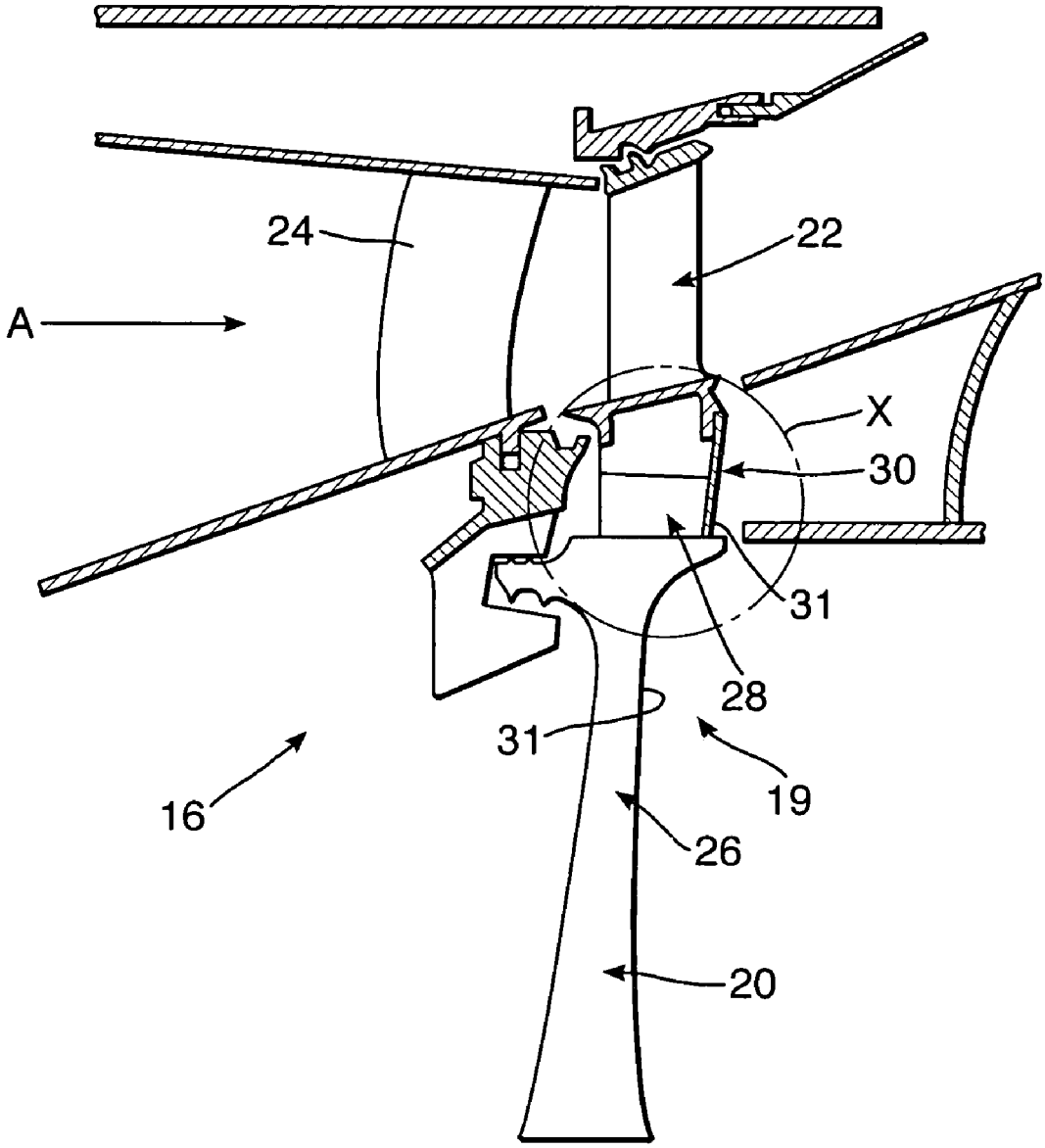
FIG. 2 is a sectional side view of an upper region of a turbine of a gas turbine engine.

Referring to FIG. 2, there is shown in more detail an upper region of the high pressure turbine 16 of the engine 10 shown in FIG. 1. The high pressure turbine 16 comprises a rotary part 19 which comprises a disc 20 upon which a plurality of turbine blades 22 are mounted. The blades 22 are mounted one after the other circumferentially around the disc and each blade 22 extends radially outwardly from the disc 20. Air passes in the direction shown by the arrow A from the combustion equipment 15 onto nozzle guide vanes 24 from which the air is directed onto the turbine blades 22, causing the rotary part 19 of the turbine 16 to rotate.

Radially inwardly of the blades 22, the disc 20 comprises a main body 26 and a plurality of blade mounting members 28 extending radially outwardly from the main body 26. the blades 22 are slid between adjacent blade mounting members 28 and secured to the disc 20 by suitable securing means in the form of a circumferentially extending seal plate 30. The seal plate 30 is secured to the down stream face 31 of the disc 20 at the blade mounting members 28. In FIG. 2 a circle marked X designates a region of the rim of the disc 20 at which the blades 22 are secured to disc 20, and a detailed diagram of this region of the rim is shown in FIG. 3.

Figure 3:
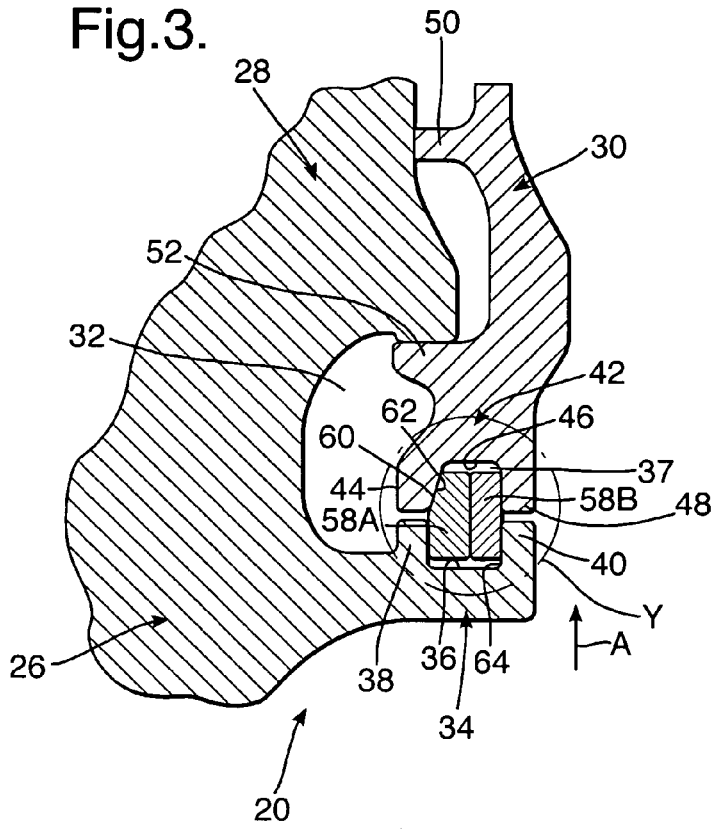
FIG. 3 is a diagrammatic cross-sectional view of the region marked X in FIG. 2.
Figure 4:
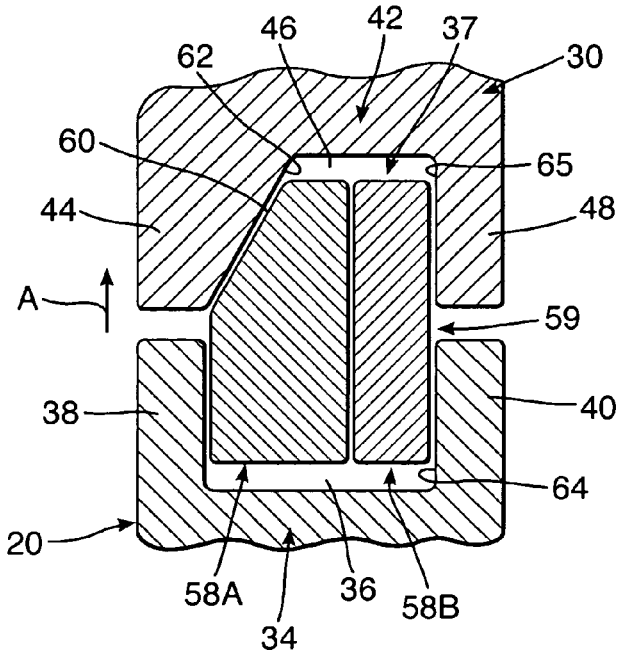
FIG. 4 is a diagrammatic cross-sectional view of the region marked Y in FIG. 3.
Figure 5:
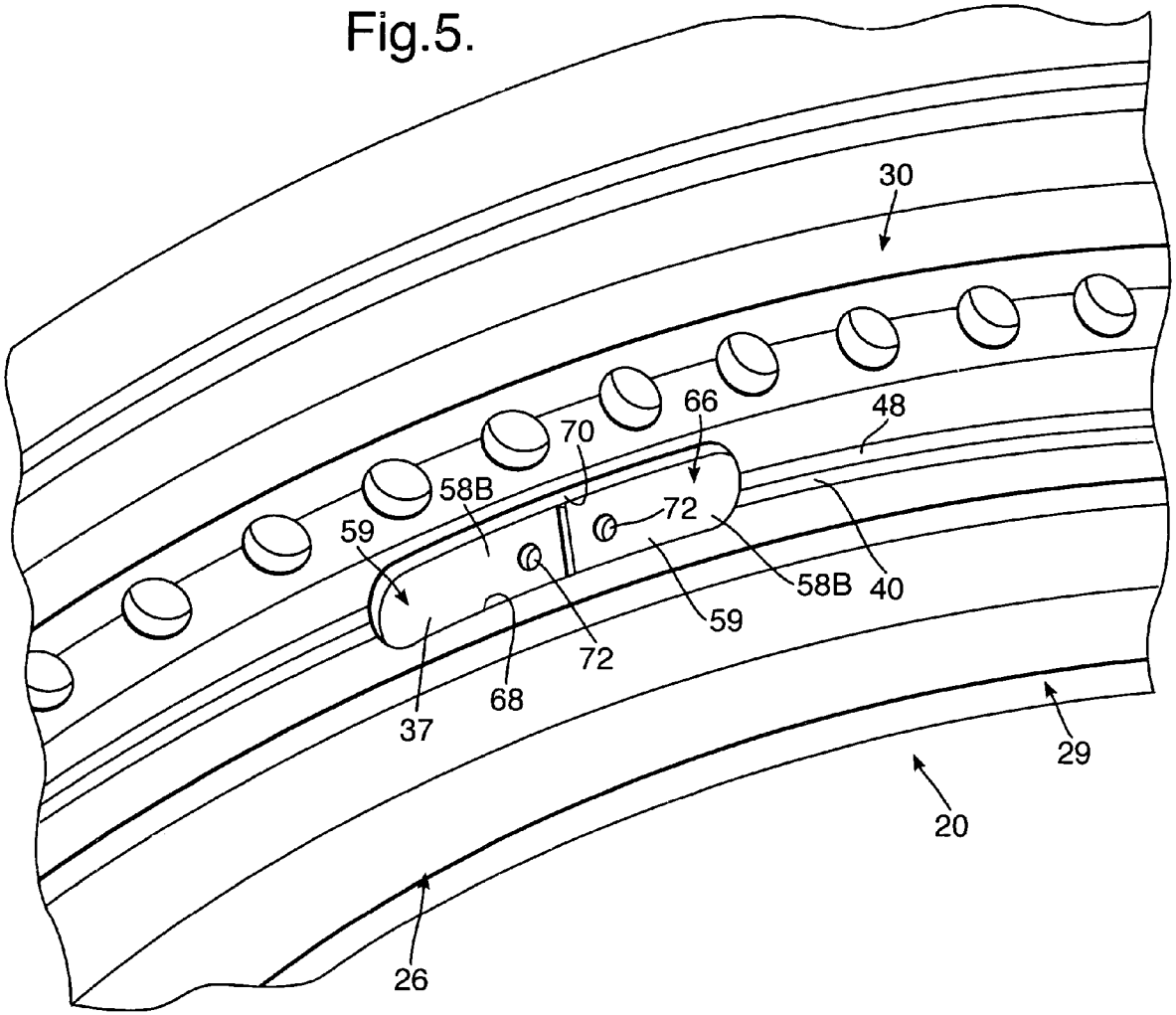
FIG. 5 is a perspective view of the parts of the assembly shown in FIG. 3.

Referring to FIGS. 3, 4 and 5 there is shown the region marked X in FIG. 2, in which it can be seen that the main body 26 of the disc 20 defines an annular groove 32 co-axial with the disc 20 and having an opening in the downstream face 31 of the disc 20. The groove 32 is defined radially inwardly of, and adjacent to, the blade mounting members 28.

The main body 26 of the disc 20 comprises a downstream extending first recess defining portion 34 which defines a first annular recess 36 between internal upstream and external downstream disc wall members 38, 40.

The seal plate 30 which may extend wholly or partially around the disc 20 comprises a second recess defining portion 42 defining a second annular recess 46 between opposite internal upstream and external downstream plate wall members 44, 48. The first and second recesses 36 and 46 are opposite to, and adjacent with, each other, and together define an internal channel 37.

The seal plate 30 also comprises an axially extending reaction portion 50 engaging the downstream face 31 of the disc 20 at the blade mounting members 28 to prevent the seal plate 30 moving in an upstream direction relative to the disc 20. The seal plate 30 also includes a radially outwardly extending portion 52 engaging the main body 26 within the groove 32. The radially extending engagement portion 52 preventing radial movement of the seal plate 30.

In order to secure the seal plate 30 to the disc 20, securing means in the form of plurality of half rings 58 are provided. The half rings 58A and 58B are slid into the channel 37 formed by the aligned annular recesses 36, 46.

Figure 6:
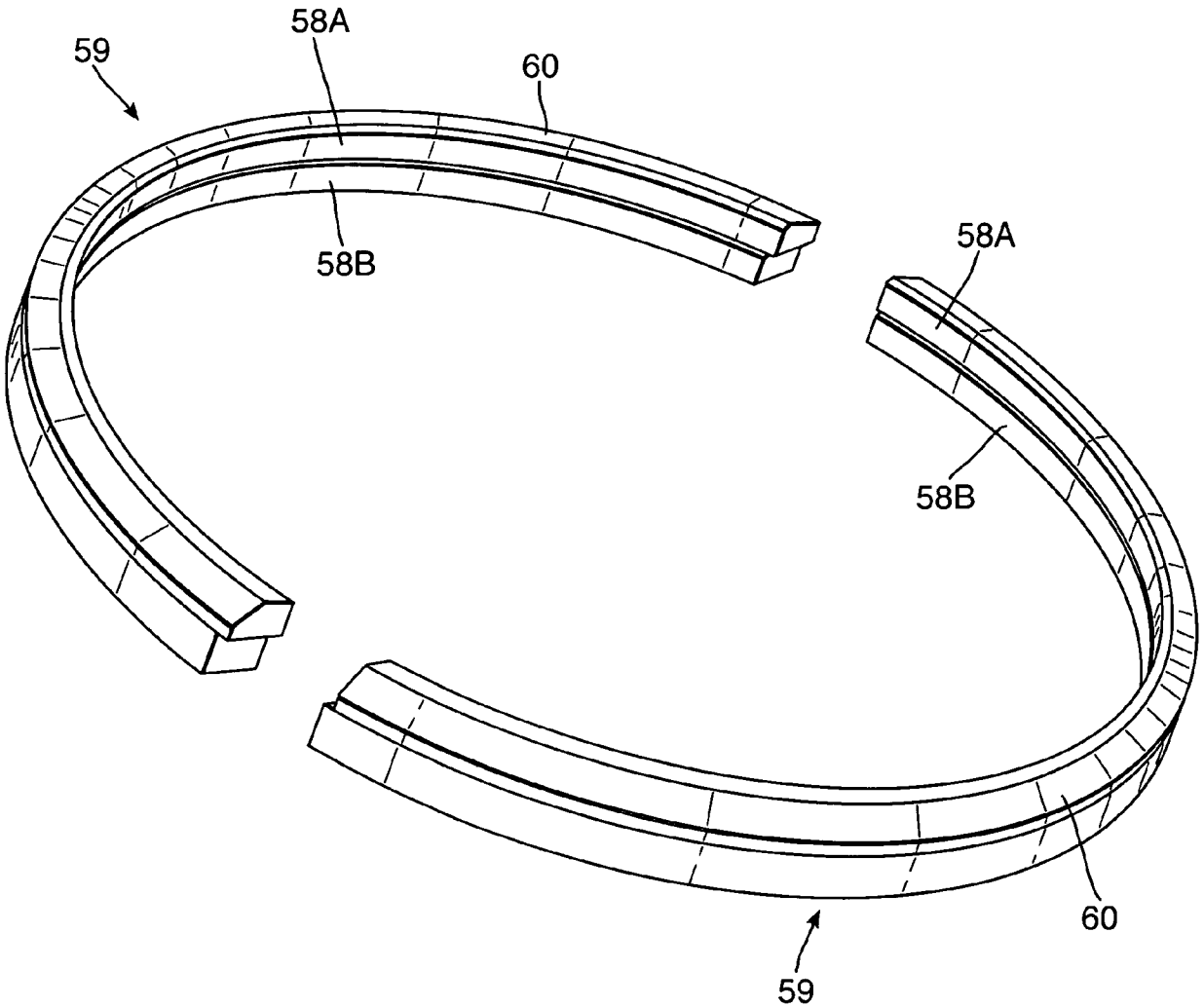
FIG. 6 is a perspective view of one embodiment of a securing means.

The half rings 58 are shown in more detail in FIGS. 4 and 6, FIG. 4 showing a close up of the region marked Y in FIG. 3 referring to FIG. 6, each of the half rings 58A, 58B extends in a semi-circle around the channel 37. The half rings 58A, 58B are arranged in two pairs 59. Each pair 59 of the rings 58A, 58B is arranged generally opposite the other pair. Each pair 59 comprises an upstream half ring 58A and a downstream ring 58B. The half rings 58A, 58B of each pair 59 are arranged generally co-axially with each other.

As can be seen from FIGS. 3 and 4, each up stream half ring 58A is provided with a first wall 60 which is chamfered relative to the axis of rotation, and which engages a second wall 62 of the seal plate wall member 44. The second face 62 is also angled to the axis of rotation. The first and second walls 60, 62 are angled relative to the axis of rotation and, hence, to the axis of the engine 10 in such a way as to urge the half rings 58A, 58B in a downstream direction.

The external wall members 40, 48 of the recess defining portions 34, 42 provides an inwardly facing engagement face 64, 65 the purpose of which will be explained below.

As shown in FIG. 5, the ring members 58A, 58B are slid into the channel 37 through an opening 66 provided in the downstream disc and seal plate wall members, 40, 48. The opening 66 is provided by aligned re-entrant formation 68, 70 in the respective disc and seal plate wall members 40, 48. The holes 72 are used to facilitate sliding of the half rings 58A, 58B into the channel 37 apertures in the walls 40, 48. Clearance is provided between the ring members 58A, 58B and the disc and seal plate wall members 38, 40 and 44, 48 to allow the half ring members 58 to be inserted into the channel 37.

When the turbine 16 is operated, the disc rotates at high speed creating a centrifugal load on the half rings 58A, 58B. This causes movement in the direction indicated by the arrow A in FIGS. 3 and 4 so that the wall 60 slides over the wall 62 thereby pushing the upstream half ring member 58A outwardly in the direction shown by the arrow A, until the downstream half ring member 58B engages the engaging faces 64, 65 of the wall members 40, 48. In this position, the seal plate 30 is secured in position. When the engine is shut down, and the turbine 19 stops rotating the centrifugal load is removed and the half ring members 58A, 58B return to their original condition.

Figure 7:
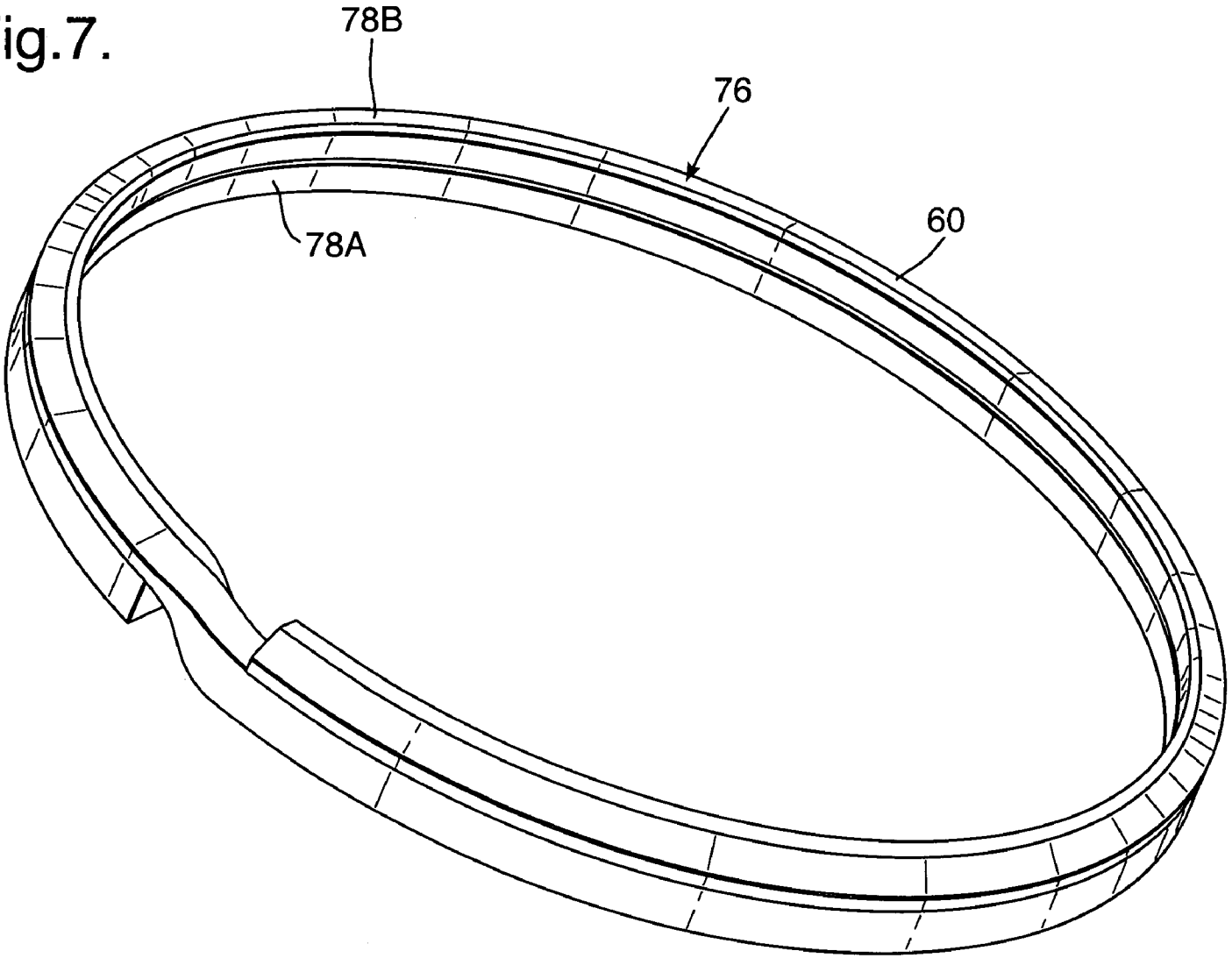
FIG. 7 is a perspective view of another embodiment of a securing means.

Referring to FIG. 7, there is shown an alternative embodiment of a securing member which consists of an annular ring 76 in the form of a single spiralled elongate member incorporating almost two full turn 78A, 78B of the elongate member. Each turns 78A, 78B engages the other turn along substantially the whole of the length of the annular member 76. The annular member 76 has a configuration known as a 'keyring' configuration. The ring member shown in FIG. 6 can be slid into position by being wound into the channel 37 defined by the recesses 36, 46 through one of the openings 66 in the wall members 40, 48.

The annular member 76 also includes a first angled wall 60 provided on the second turn 78B. The first angled wall 60 shown in FIG. 7 is the same as the angled wall 60 shown in the other embodiments and engages the second angled face 62 in the channel 37.

Thus, the above described embodiments provide the advantage that during assembly of the turbine 16, all the components have a clearance fit, thereby allowing easy assembly and disassembly.

Various modifications can be made without departing from the scope of the invention. For example, the half rings 58A, 58B could be replaced by split rings, such that a single split ring replaces the two upstream half rings 58A, and a further style split ring replaces the two down stream half rings 58B. Each split ring is in the form of an annular member having a radially extending break therein.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A securing assembly comprising:

a first rotatable member defining a first recess, and a second rotatable member defining a second recess, the second recess having an engagement formation, securing means rotatable in the first and second recesses for securing the first and second rotatable members to each other, and an urging formation provided on at least one of the securing means and the first rotatable member for urging the securing means into engagement with the engagement formation when the first and second rotatable members are rotated, comprising an urging wall of the first recess, the urging wall being angled relative to the axis of rotation of the first and second rotatable members to effect the aforesaid urging of the securing means.

2. A securing arrangement according to claim 1, wherein the engagement formation comprises an engagement wall.

3. A securing arrangement according to claim 1, wherein an urging formation is provided on the securing means.

4. A securing arrangement according to claim 3, wherein the urging formation on the securing means comprises an urging wall, chamfered relative to the axis of rotation of the first and second rotatable members.

5. A securing arrangement according to claim 4, wherein the urging wall of the recess and the urging wall of the securing means define the same angle relative to the axis of rotation.

6. A securing arrangement according to claim 5, wherein the urging walls face each other and the urging wall of the recess faces inwardly of the recess.

7. A securing arrangement according to claim 1, wherein the first and second rotatable members each comprises first and second recess defining portions to define the first and second recesses, the first and second recess defining portions extending through at least an arc of a circle.

8. A securing arrangement according to claim 7, wherein at least one of the first and second recess defining portions is generally annular.

9. A securing arrangement according to claim 8, wherein both of the first and second recess defining portions are annular.

10. A securing arrangement according to claim 7, wherein the first recess defining portions of each rotatable member comprise external walls, wherein the external walls define respective re-entrant formations which when aligned with each other provide an opening to enable the securing means to be located within the recess.

11. A securing arrangement according to claim 1, wherein the first and second recesses are aligned with each other to define an internal channel when the securing means is received therein.

12. A securing arrangement according to claim 1, wherein the securing means includes at least one securing member, locatable in the first and second recesses.

13. A securing arrangement according to claim 12, wherein the at least one securing member is slidable into the first and second recesses.

14. A securing arrangement according to claim 13, wherein a pair of said securing members are locatable in general co-axial alignment with each other in the recesses.

15. A securing arrangement according to claim 14, wherein each securing member comprises a half ring.

16. A securing arrangement according to claim 15, wherein two pairs of securing members arranged opposite to each other around an annulus, wherein securing members of each pair are arranged co-axially of each other, and each securing member extends generally around a semi-circle of the annulus.

17. A securing arrangement according to claim 14, wherein each securing member is annular in configuration, and each has a break therein.

18. A securing arrangement according to claim 17, wherein the break extends radially across the securing member.

19. A securing arrangement according to claim 18, wherein each securing member comprises a split ring.

20. A securing arrangement according to claim 12, wherein the securing member is annular in configuration, and comprises a spiralled elongate member comprising a first portion overlapping a second portion.

21. A securing arrangement according to claim 20, wherein the securing member comprises a spiral member having generally two full turns, wherein each turn engages an adjacent turn.

22. A securing arrangement according to claim 12, wherein the securing members are slidable into the recesses.

23. A rotary component of a gas turbine engine incorporating a securing assembly according to claim 1.

24. A rotary component according to claim 23 comprising a turbine.

25. A gas turbine engine incorporating a rotary component according to claim 23.

* * * * *